US012180802B2

(12) United States Patent
Eaton et al.

(10) Patent No.: US 12,180,802 B2
(45) Date of Patent: Dec. 31, 2024

(54) HYBRID COMPOSITE AND DISSOLVABLE DOWNHOLE TOOL

(71) Applicant: INNOVEX DOWNHOLE SOLUTIONS, INC., Houston, TX (US)

(72) Inventors: Jeremy Eaton, Houston, TX (US); Brandon Goodman, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 145 days.

(21) Appl. No.: 17/827,073

(22) Filed: May 27, 2022

(65) Prior Publication Data

US 2023/0258051 A1 Aug. 17, 2023

Related U.S. Application Data

(60) Provisional application No. 63/309,822, filed on Feb. 14, 2022.

(51) Int. Cl.
*E21B 33/129* (2006.01)
*E21B 23/00* (2006.01)
*E21B 33/134* (2006.01)

(52) U.S. Cl.
CPC ..... *E21B 33/129* (2013.01); *E21B 23/00* (2013.01); *E21B 33/134* (2013.01); *E21B 2200/08* (2020.05)

(58) Field of Classification Search
CPC .... E21B 2200/08; E21B 23/00; E21B 33/129; E21B 33/134
See application file for complete search history.

(56) References Cited

U.S. PATENT DOCUMENTS

| | | | | |
|---|---|---|---|---|
| 10,119,359 | B2 * | 11/2018 | Frazier | E21B 43/26 |
| 10,337,279 | B2 * | 7/2019 | Frazier | E21B 33/134 |
| 10,435,982 | B2 * | 10/2019 | Shkurti | E21B 33/129 |
| 10,570,694 | B2 * | 2/2020 | Davies | E21B 33/134 |
| 11,365,600 | B2 * | 6/2022 | Greenlee | E21B 33/134 |
| 11,486,226 | B2 * | 11/2022 | Nichols | E21B 34/12 |
| 2013/0048271 | A1 * | 2/2013 | VanLue | E21B 23/06 166/387 |
| 2014/0020911 | A1 * | 1/2014 | Martinez | E21B 33/129 166/134 |
| 2014/0224506 | A1 * | 8/2014 | Xu | E21B 33/129 166/376 |
| 2014/0311752 | A1 * | 10/2014 | Streich | E21B 33/134 166/376 |
| 2017/0234103 | A1 * | 8/2017 | Frazier | E21B 33/1291 166/138 |
| 2017/0260825 | A1 * | 9/2017 | Schmidt | E21B 33/1292 |
| 2018/0148993 | A1 * | 5/2018 | Schmidt | E21B 33/1291 |

(Continued)

*Primary Examiner* — Daniel P Stephenson
(74) *Attorney, Agent, or Firm* — MH2 Technology Law Group, LLP

(57) ABSTRACT

A downhole tool includes a cone, a slips assembly positioned at least partially around the cone, and a shoe configured to press against the slips assembly. The shoe is configured to engage a setting assembly, so as to apply an axial force to the slips assembly that moves the slips assembly relative to the cone and drives the slips assembly radially outwards. The shoe is made at least partially from a dissolvable material configured to dissolve in a fluid in a well, and the cone, the slips assembly, or both are at least partially made from a second material that is configured not to dissolve in the fluid in the well.

20 Claims, 6 Drawing Sheets

(56) References Cited

U.S. PATENT DOCUMENTS

| | | | | |
|---|---|---|---|---|
| 2018/0179851 | A1* | 6/2018 | Davies | E21B 23/01 |
| 2018/0274325 | A1* | 9/2018 | Greenlee | E21B 33/128 |
| 2019/0323314 | A1* | 10/2019 | Hughes | E21B 33/1285 |
| 2019/0352998 | A1* | 11/2019 | Wolf | E21B 33/12 |
| 2020/0347694 | A1* | 11/2020 | Power | E21B 23/06 |
| 2020/0392807 | A1* | 12/2020 | Greenlee | E21B 33/0422 |
| 2020/0392808 | A1* | 12/2020 | Greenlee | E21B 33/134 |
| 2021/0054719 | A1* | 2/2021 | Nichols | E21B 34/12 |
| 2021/0381334 | A1* | 12/2021 | Goodman | E21B 33/128 |
| 2023/0258051 | A1* | 8/2023 | Eaton | E21B 33/134 166/376 |

* cited by examiner

HYBRID COMPOSITE AND DISSOLVABLE DOWNHOLE TOOL

CROSS-REFERENCE TO RELATED APPLICATIONS

This application claims priority to U.S. Provisional Patent Application No. 63/309,822, which was filed on Feb. 14, 2022, and is incorporated by reference herein in its entirety.

BACKGROUND

Downhole tools may be installed in a well to perform a variety of tasks. For example, one type of downhole tool is a plug. Plugs are sometimes used to isolate one well section or "zone" from another, e.g., to permit directing pressurized fluid to a particular location for hydraulic fracturing or other activities. Such tools are typically set in the well by pressing slips radially outward, so that the slips bite into the surrounding tubular (e.g., casing or open-hole), thereby securing the tool in position.

At some point, it may be desirable to remove the tool from the well. Continuing with the example of plugs, it may be desirable to restore fluid communication in the well between the now-isolated zones. Some tools are "retrievable", meaning that the setting process can be reversed, so that the slips are retracted and the tool can be removed from the well. Other tools are not designed to be retrieved but can be drilled out. More recently, dissolvable tools have been introduced as another type of non-retrievable tool.

Challenges are present in both the traditional, drillable tools and dissolvable tools, however. Tools that are designed to be drilled or milled out are typically made of a material that is easily drilled, such as a composite (carbon or glass fiber reinforced material). However, during the milling process, once the bit removes the slips of the tool, the tool may begin to spin with the bit and/or fall off into the well, which can present the possibility for debris interfering with subsequent operations. With dissolvable tools, the dissolution rate and timing can be difficult to control, and the materials can have unreliable properties (e.g., shear strength).

SUMMARY

Embodiments of the disclosure include a downhole tool that includes a cone, a slips assembly positioned at least partially around the cone, and a shoe configured to press against the slips assembly. The shoe is configured to engage a setting assembly, so as to apply an axial force to the slips assembly that moves the slips assembly relative to the cone and drives the slips assembly radially outwards. The shoe is made at least partially from a dissolvable material configured to dissolve in a fluid in a well, and the cone, the slips assembly, or both are at least partially made from a second material that is configured not to dissolve in the fluid in the well.

Embodiments of the disclosure include a method including connecting a setting assembly to a downhole tool comprising a slips assembly, a cone positioned at least partially in the slips assembly, and a shoe, deploying the downhole tool and the setting assembly include a well, attempting to set the downhole tool in the well using the setting assembly, withdrawing the setting assembly from the well while leaving the downhole tool in the well, wherein the shoe dissolves in a fluid in the well, and drilling out the slips assembly, the cone, or both after dissolving the at least a portion of the shoe.

Embodiments of the disclosure include a downhole tool including a cone having a bore, a first seat positioned in the bore, and a second seat positioned in the bore, the second seat extending from an uphole end of the cone, and the first seat being axially offset from the uphole end, a slips assembly positioned at least partially around the cone, and a shoe configured to press against the slips, wherein the shoe is configured to engage a setting assembly, so as to apply an axial force to the slips assembly that moves the slips assembly relative to the cone and drives the slips assembly radially outwards. The shoe is made at least partially from a dissolvable material configured to dissolve in a fluid in a well, and the cone, the slips assembly, or both are at least partially made from a composite material that is configured not to dissolve in the fluid in the well.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
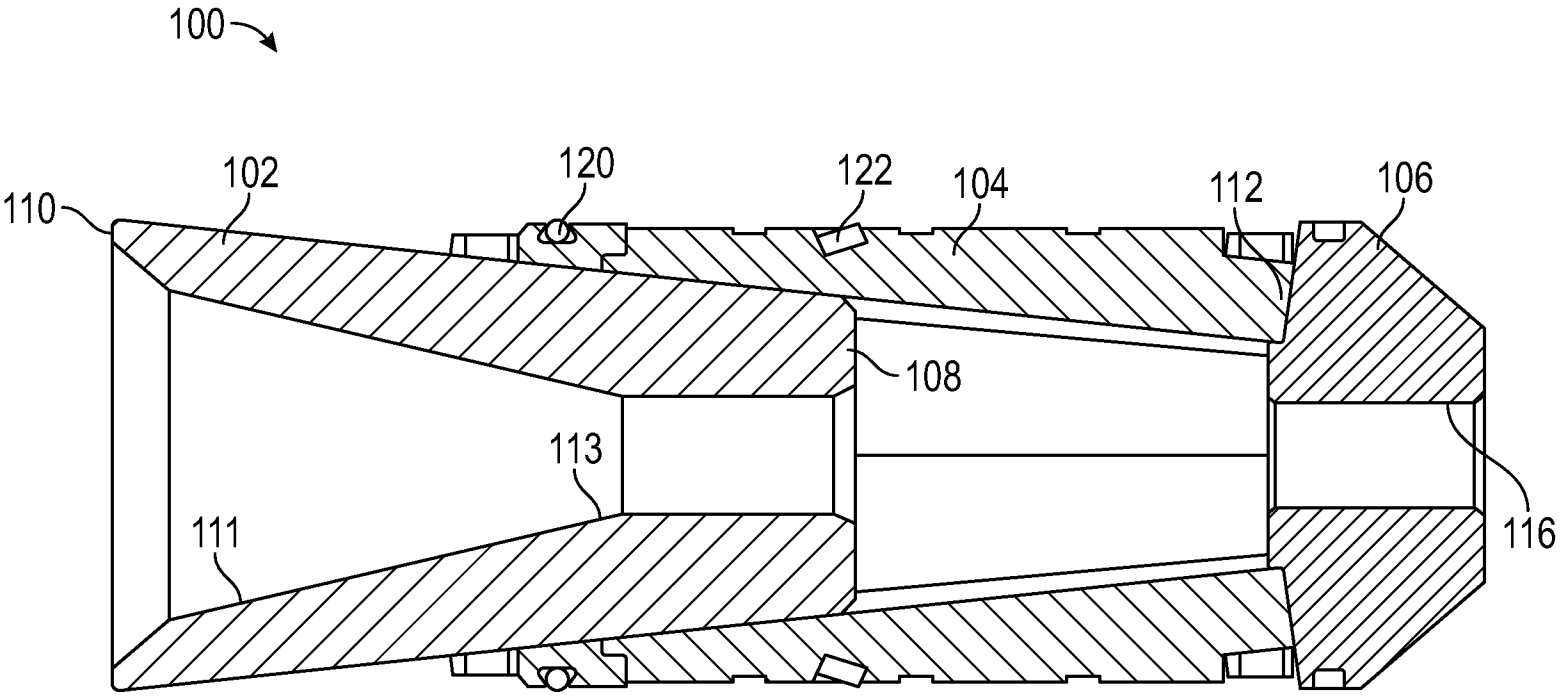
FIG. 1 illustrates a side, cross-sectional view of a downhole tool in an unset configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, cross-sectional view of a downhole tool 100, according to an embodiment. The tool 100 may be a plug, such as a frac plug, which may be configured to receive an obstructing member. Once the tool 100 receives the obstructing member, as will be described in greater detail below, the tool 100 may prevent fluid communication at least in a downhole direction. The illustrated tool 100 includes a cone 102, a slips assembly 104, and a shoe 106. It will be appreciated that other types of tools may be used, such as bridge plugs and the like. Further, the illustrated embodiment, which does not include a central mandrel, is merely a descriptive example, and not to be considered limiting. Indeed, embodiments that do include such a mandrel and a slips assembly positioned around the mandrel are expressly contemplated herein.

The cone 102 is tapered, as shown, increasing in outer diameter as proceeding axially from a first end 108 to a second end 110, with the second end 110 being uphole of the first end 108 when the tool 100 is in a well. A bore 111 may extend through the cone 102, and a valve seat 113 may be formed by the bore 111 within the cone 102. Further, the cone 102 is received at least partially within the slips assembly 104, such that the slips assembly 104 is at least partially around the cone 102, e.g., proximal to the first end 108.

The shoe 106 may be positioned to engage a downhole end 112 of the slips assembly 104 and apply an axial force thereto. Further, the shoe 106 may include a bore 116 therein, which may be, for example, threaded for connection to a setting rod, as will be described in greater detail below. The setting rod may pull in an uphole direction on the shoe 106, while a setting sleeve presses on the second end 110 of the cone 102. Thus, the shoe 106 and the cone 102 are adducted toward one another, thereby driving the cone 102 farther into the slips assembly 104. In turn, the slips assembly 104 is pressed radially outward by the tapered cone 102, such that the slips assembly 104 bites into the surrounding tubular (e.g., casing, liner, open-hole wellbore wall, etc.), to set the tool 100 in the well.

The slips assembly 104 may be made of a relatively soft (e.g., compared to steel) material such as a fiber-reinforced ("composite") material. Such material can be formed in a variety of different ways, including by molding. Further, the slips assembly 104 and/or other parts of the downhole tool 100 may include various seals 120, ceramic or carbide buttons 122 (which are harder than steel and thus permit the slips assembly 104 to bite into the steel of the surrounding tubular, if present), etc. Likewise, in at least some embodiments, the cone 102 may be made from such a composite or other relatively soft, easily-drillable material. In some embodiments, either or both of the cone 102 and/or the slips assembly 104 may be constructed at least partially from such composite material.

The shoe 106 may be made at least partially from a dissolvable material, such as magnesium. The dissolvable material may be configured to dissolve in a preselected well fluid, such as acid or another solvent, which may be located in the well and may be referred to herein as "dissolving fluid". The composite material may be configured not to dissolve in the same dissolving fluid.

Figure 2:
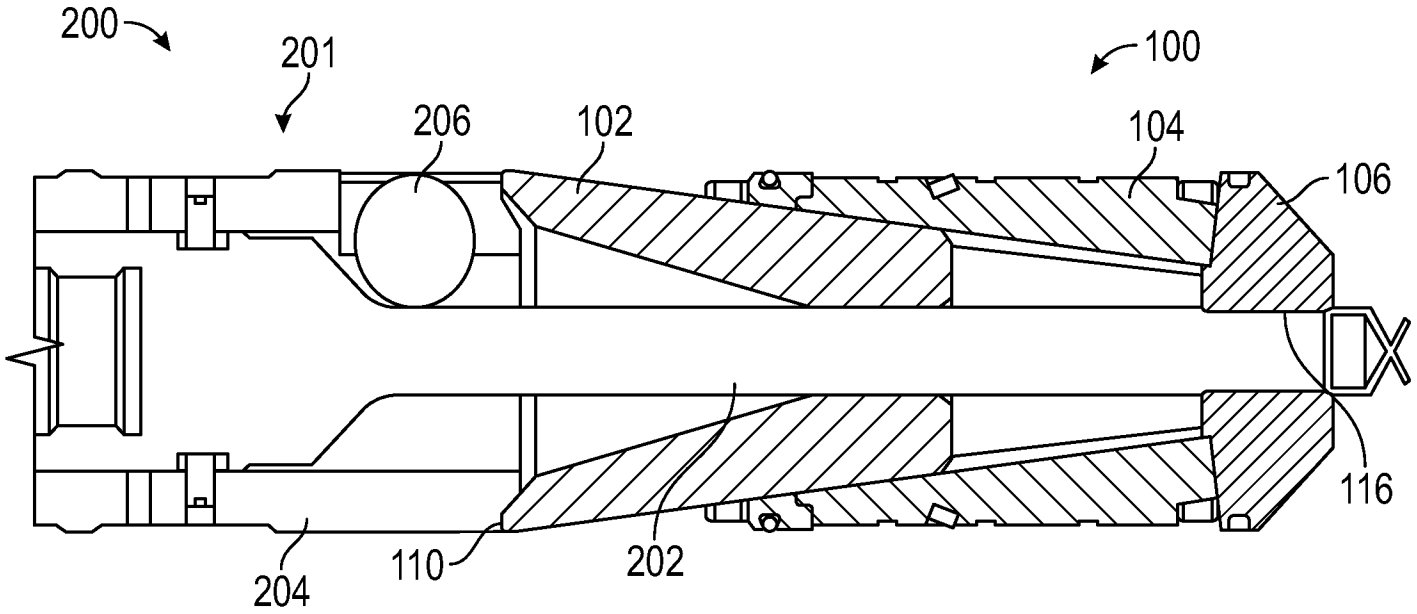
FIG. 2 illustrates a side, cross-sectional view of a downhole assembly including a setting tool and the downhole tool, according to an embodiment. The downhole tool remains in the unset configuration in this view.

FIG. 2 illustrates a side, cross-sectional view of a downhole assembly 200 including the downhole tool 100 and a setting tool 201. The setting tool 201 includes a setting rod 202 that extends through the downhole tool 100 and connects to the bore 116 of the shoe 106. The setting tool 201 also includes a setting sleeve 204 that is configured to press against the second end 110 of the cone 102. An obstructing member (e.g., ball) 206 is also provided as part of the setting tool 201. When the setting rod 202 shears from or otherwise disconnects from the shoe 106, the setting tool 201 is withdrawn away from the tool 100 and the obstructing member 206 falls into the valve seat 113 provided by the cone 102, thereby preventing fluid flow in a downhole direction through the tool 100, but potentially allowing fluid flow in an uphole direction therethrough. In another embodiment, the setting tool does not include the obstructing member. In this embodiment, the obstructing member may be dropped into the well.

Figure 3:
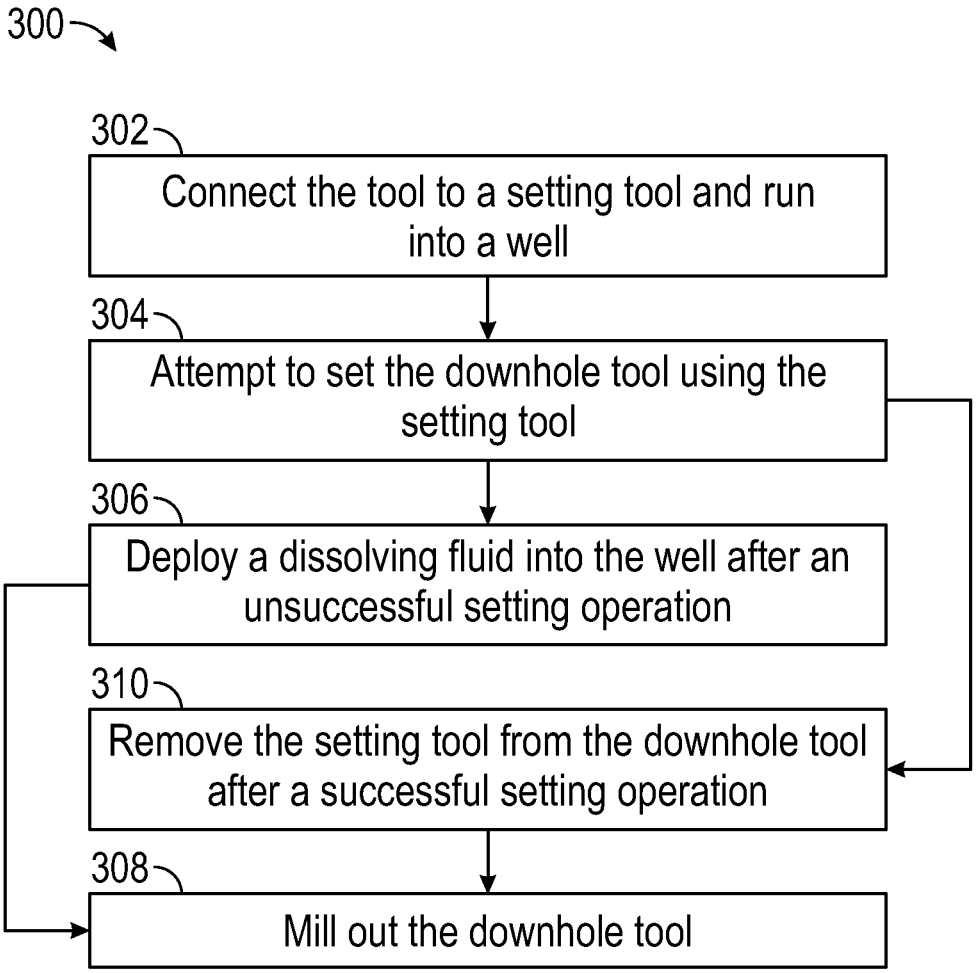
FIG. 3 illustrates a flowchart of a method for operating a downhole tool, according to an embodiment.

FIG. 3 illustrates a flowchart of a method 300 for operating a downhole tool, according to an embodiment. The method 300 may be executed using an embodiment of the downhole tool 100 and/or the setting tool 201, but at least some embodiments of the method 300 may employ other devices. Further, the steps of the method 300 may be executed in the order presented herein, or in any other order. At least one of the steps may be partitioned into two or more separate steps, and/or any two of the steps may be combined into a single step, without departing from the scope of the present disclosure.

The tool 100 may be connected to the setting tool 201 and run into a well, using any type of tool string, wireline, etc., as at 302. The method 300 may then proceed to attempting to set the tool 100 by expanding the slips assembly 104 radially outward using the shoe 106, as at 304. For example, as discussed above, the cone 102 and the shoe 106 may be adducted together using the setting tool 201.

In some cases, the setting process may fail. For example, the slips assembly 104 may only partially set. In such case, the slips assembly 104 may not provide sufficient holding force to permit a shearing of the connection between the shoe 106 and the setting rod 202 (e.g., FIG. 2), but may also not permit free removal of the tool 100 from the well. Such partial/failed setting may be determined during the setting process. In another example, the setting tool 201 may not provide sufficient setting because of a charge burn misfire or setting tool failure. Accordingly, to remediate, the method 300 may include deploying a dissolving fluid into the well, as at 306. The dissolving fluid may dissolve the shoe 106, thereby releasing the setting tool 201 from the downhole tool 100. The downhole tool 100 may then be milled (i.e., drilled) out, as at 308.

Figure 4A:
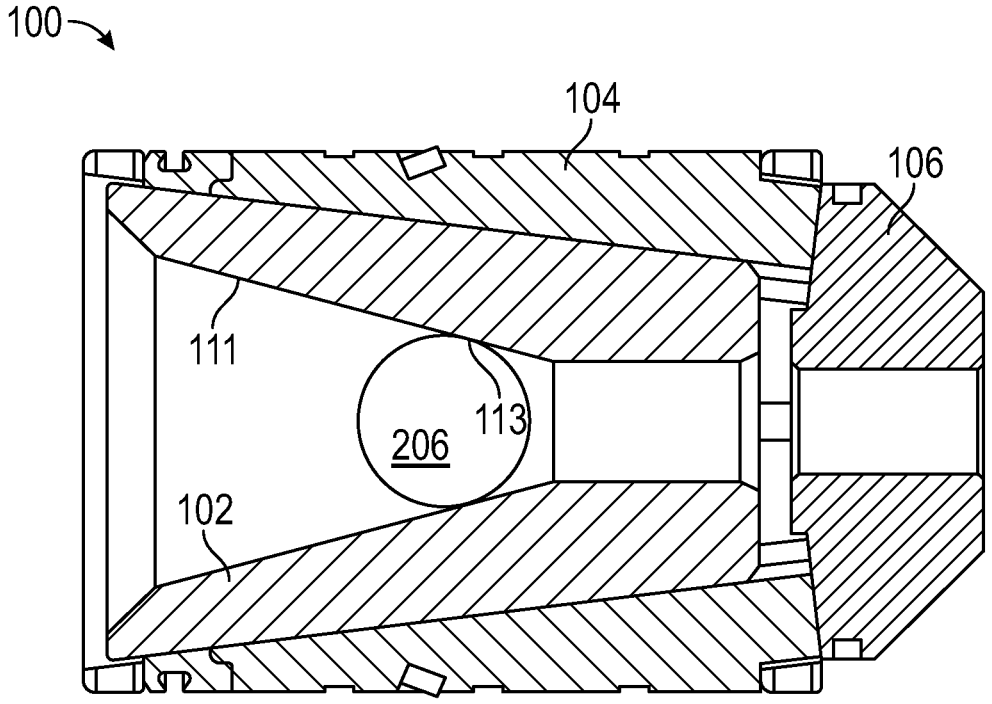
FIG. 4A illustrates a side, cross-sectional view of the downhole tool in a set configuration, according to an embodiment.

In other cases, the setting process may be successful. The tool 100 in a set configuration is shown in FIG. 4A. As shown, the cone 102 is driven into the slips assembly 104, the slips assembly 104 is set and the setting tool 201 (e.g., FIG. 2) is removed from connection with the shoe 106, as at 310. The shoe 106 may remain attached to the slips assembly 104 or may fall away therefrom.

Figure 4B:
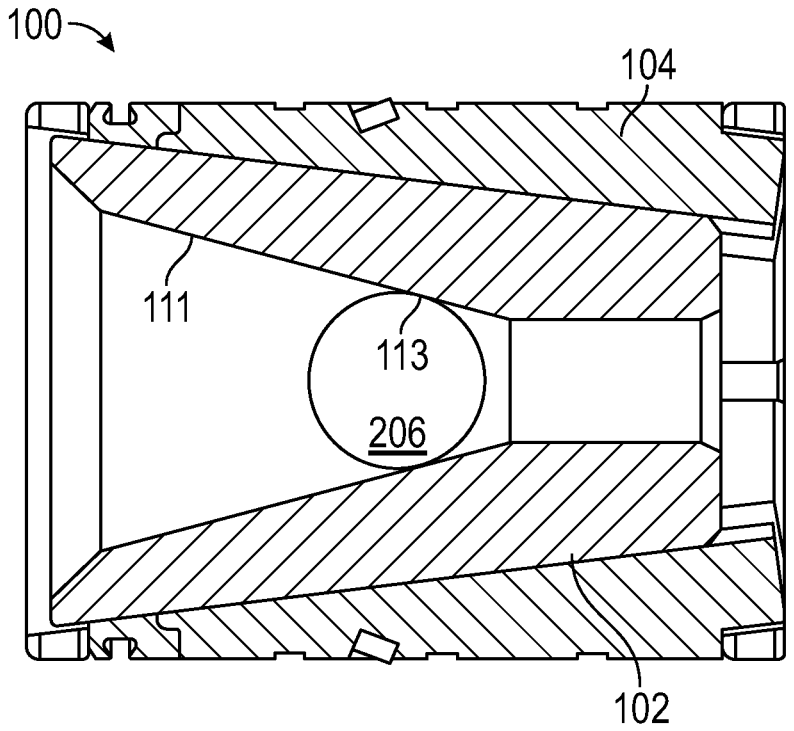
FIG. 4B illustrates a side, cross-sectional view of the downhole tool in the set configuration, after a shoe thereof has been dissolved, according to an embodiment.

The shoe 106 may then be permitted to dissolve, as shown in FIG. 4B, in the wellbore environment, e.g., by leaving the tool 100 in the well for a certain duration. For example, with the shoe 106 (e.g., FIG. 4A) detached from the slips assembly 104, the full surface area of the shoe 106 may be exposed to the dissolving fluid. This may avoid the shoe 106 obstructing fluid flow through the tool 100, while also avoid the shoe 106 becoming debris in the well.

The method 300 may then include drilling out the undissolved portion of the tool 100, as at 308. With the shoe 106 (e.g., FIG. 4A) already having dissolved away, it may not obstruct the drilling process or otherwise become debris. Further, the slips assembly 104 and/or cone 102 being made at least in part from a composite, non-dissolvable material may avoid premature loss of integrity of the tool 100 during use, prior to being milled out. Such composite or other non-dissolving components may be milled out.

Figure 5:
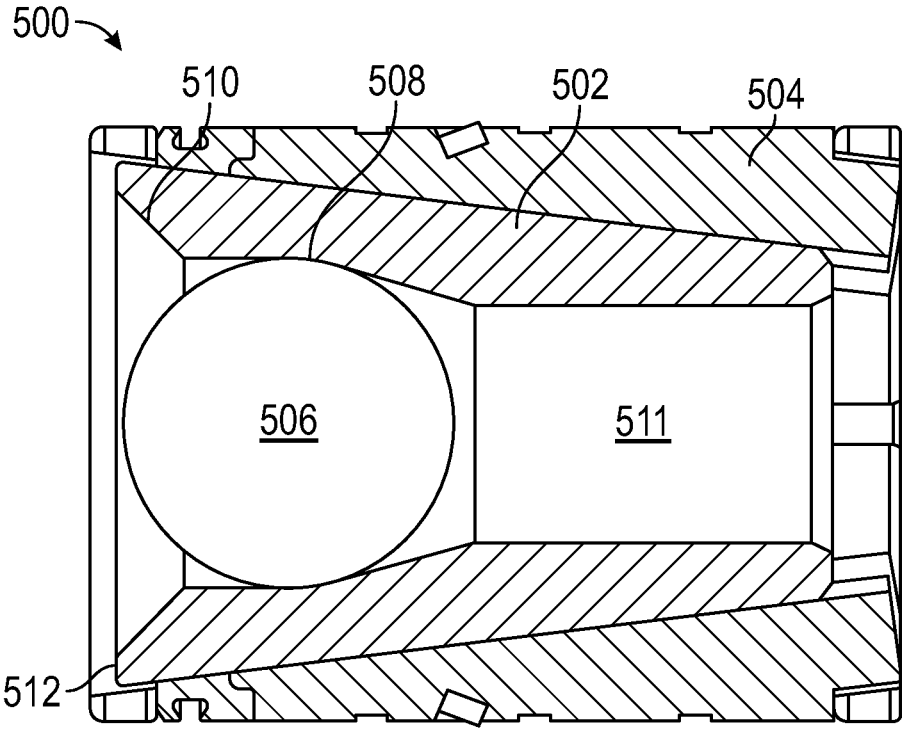
FIG. 5 illustrates a side, cross-sectional view of another downhole tool, showing a first impediment received therein, according to an embodiment.

FIG. 5 illustrates a side, cross-sectional view of another downhole tool 500 in a first, set configuration, according to an embodiment. The downhole tool 500 may be similar to the downhole tool 100, and may be set, for example, using the setting tool 201 of FIG. 2. The tool 500 includes a cone 502 and a slips assembly 504. During deployment, the tool 500 may also include a shoe, e.g., a partially-dissolvable shoe, as discussed above with respect to the tool 100. In the illustrated view, the shoe has already been removed, e.g., by dissolving, falling away from the slips assembly 504, or both.

The cone 502 may be advanced into the slips assembly 504. As shown, the cone 502 may be wedge-shaped, and thereby advancing the cone 502 into the slips assembly 504 may drive the slips assembly 504 radially outward and into engagement with the surrounding tubular. This may be at least partially accomplished through use of the setting tool 201. Additionally, a first impediment 506 may be used to press the cone 502 into the slips assembly 504, while blocking fluid flow to support wellbore operations, such as hydraulic fracturing.

Specifically, in an embodiment, the cone 502 may include a first seat 508 and a second seat 510, which may be formed by changes in diameter in a bore 511 defined through the cone 502. The bore 511 may extend axially entirely through the cone 502, such that the cone 502 permits fluid flow therethrough, unless obstructed, e.g., by the first impediment 506. The first seat 508 may be at least about ¼ or at least about ⅓ of the axial length of the cone 502 from an upper end 516 of the cone 502. The second seat 510 may be near the upper end 516, between the upper end 516 and the first seat 508, e.g., extending from the upper end 516, as shown. In some embodiments, the second seat 510 may be a beveled surface that defines at least a part of the upper end 516. The first seat 508 may be positioned such that the first impediment 506 is entirely within the cone 502 when received into the first seat 508. For example, the first seat 508 may be farther axially away from the upper end 512 than the radial dimension of the first seat 508, such that a spherical embodiment of the first impediment 506 is entirely within the cone 502 when engaging the first seat 508. In other embodiments, other shapes may be used for the first impediment 506, and thus the location of the first seat 508 may be changed accordingly.

The second seat 510 may have a larger radial dimension than the first seat 508. Accordingly, the first impediment 506, which is sized to engage the first seat 508, may move past the second seat 510 on its path to the first seat 508. When the first impediment 506 engages the first seat 508, pressure uphole (to the left in this view) of the tool 500 may provide a downhole-directed pressure on the first impediment 506, which is transmitted to the cone 502. This force drives the cone 502 into the slips assembly 504. Additionally, because the first seat 508 is within the cone 502, the first impediment 506 provides additional strength and rigidity to the cone 502. That is, when the cone 502 is forced axially into the slips assembly 504, the slips assembly 504 applies a reactionary force on the cone 502. This reactionary force may increase as the slips assembly 504 is pressed against the surrounding tubular. The first impediment 506 being in the first seat 508 may prevent the cone 502 from deflecting radially inward and failing.

Figure 6:
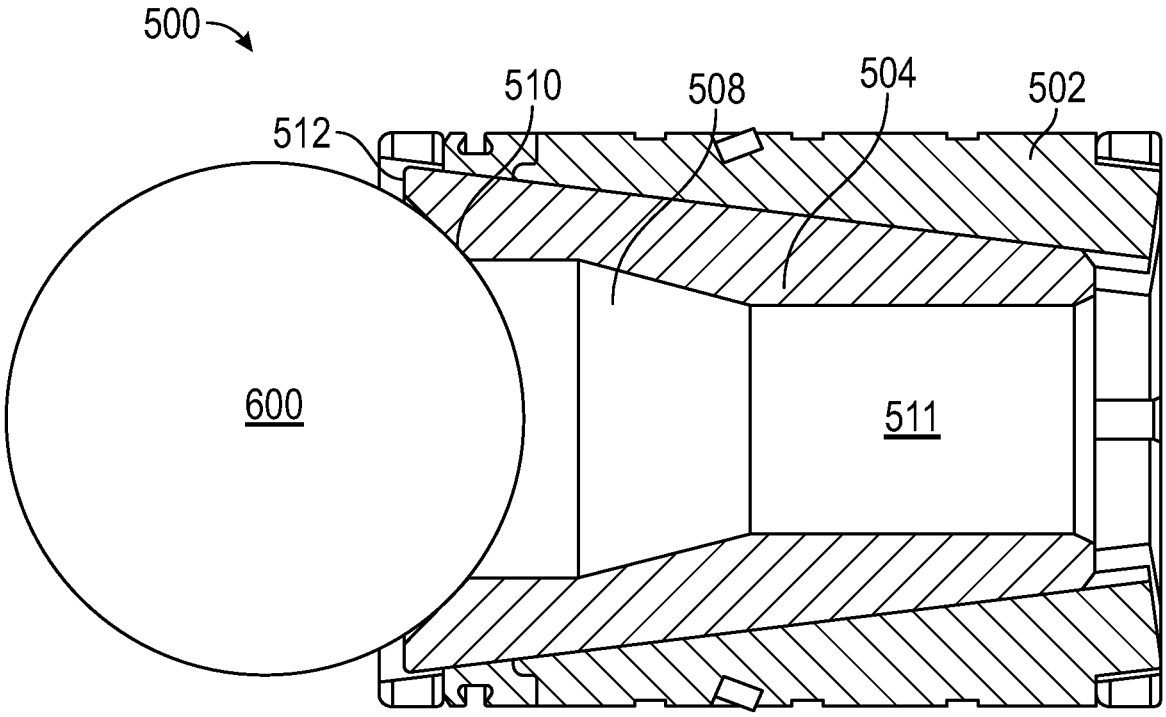
FIG. 6 illustrates a side, cross-sectional view of the downhole tool of FIG. 5, showing a second impediment received therein, according to an embodiment.

In some situations, it may be desirable to remove the tool 500 from the well. Such removal is typically done by dissolving or milling the downhole tool out of the well. However, in the present embodiment, as shown in FIG. 6, a second impediment 600 may be deployed, which may land on the second seat 510. This may occur, for example, before the first impediment 508 is installed, after the first impediment 508 has been dissolved, and/or circulated back out of the well, or otherwise removed from the cone 502. The second impediment 600 may press against the second seat 510, which may produce the axial load on the cone 502; however, the second seat 510 may be formed near to the upper end 512 of the cone 502. The second impediment 600 may not be within the cone 502 while this force is being applied, and thus the second impediment 600 may not provide the increased strength/rigidity to the internal structure of the cone 502, like the first impediment 506 does when the first impediment 506 is received in the first seat 508. As a result, the cone 502 may deflect radially inwards, and potentially yield or collapse under the radially-inward directed reactionary forces applied by the slips assembly 504 onto the cone 502. Once this occurs, the cone 502 may no longer be capable of pressing the slips assembly 504 outwards. As such, the tool 500 may be in an unset condition, and may be retrieved or permitted to drop to the bottom of the well.

Figure 7:
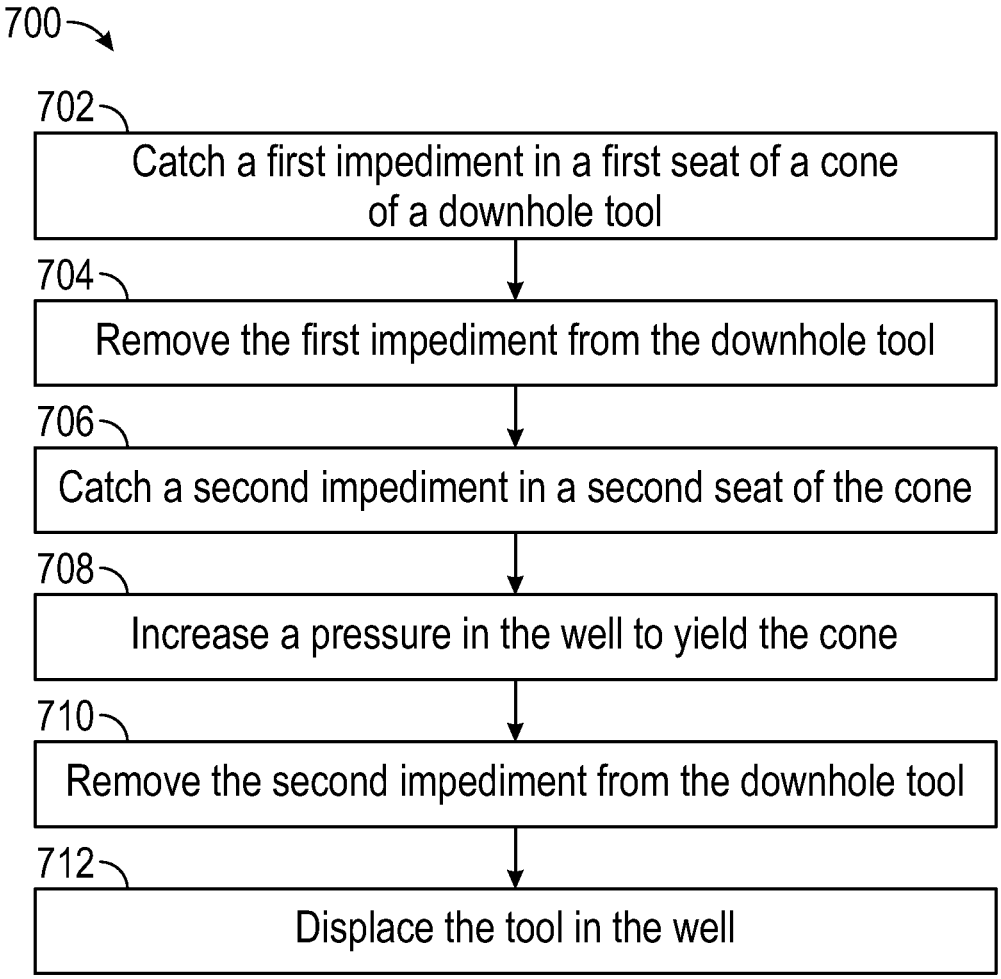
FIG. 7 illustrates a flowchart of a method for deploying a downhole tool, according to an embodiment.

FIG. 7 illustrates a flowchart of a method 700 for deploying a downhole tool into a well, according to an embodiment. The method 700 may be executed using an embodiment of the downhole tool 500, but at least some embodiments of the method 700 may employ other devices. Further, the steps of the method 700 may be executed in the order presented herein, or in any other order. At least one of the steps may be partitioned into two or more separate steps, and/or any two of the steps may be combined into a single, continuous step, without departing from the scope of the present disclosure. One or more of the steps may also be omitted.

The method 700 may include catching a first impediment 506 in a first seat 508 of a cone 502 of the downhole tool 500, as at 702. As described above, the cone 502 may be configured to press a slips assembly 504 radially outward, at least partially through operation of a setting tool 201. Further, by catching the first impediment 506, the tool 500 may block pressure communication therethrough in the well, and thus pressure may be increased uphole of the tool 500. Such pressure may be applied to the cone 502 via the first impediment 506. The first impediment 506 caught in the first seat 508, which may be within the cone 502, may resist inward deflection of the cone 502. At some point, e.g., by flowing back, dissolving, or another operation, the first impediment 506 may be removed from the cone 502, as at 704.

The method 700 may also include catching a second impediment 600 in a second seat 510 of the tool 500, as at 706. The pressure may then be increased in the well, uphole of the tool 500, as at 708, such that an axially-directed force is applied to the cone 502 at least partially via the second impediment 600. The second impediment 600 caught in the second seat 510 may not prevent the cone 502 from radial-inward deflection through application of the reactionary load applied thereto from the slips assembly 504. Thus, under a predetermined load, the cone 502 may yield radially inwards, such that it is no longer able to force the slips assembly 504 radially outwards with sufficient force to anchor the downhole tool 500 in place in the well. The second impediment 600 may then be displaced from the well (e.g., by dissolving, flowing back, etc.), as at 710, and the tool 500, now in an unset condition, may also be displaced (e.g., retrieved, permitted to fall to the bottom of the well, etc.), as at 712.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method, comprising:

connecting a setting assembly to a downhole tool comprising a slips assembly, a cone positioned at least partially in the slips assembly, and a shoe;

deploying the downhole tool and the setting assembly into a well;

attempting to set the downhole tool in the well using the setting assembly;

determining that attempting to set the downhole tool is unsuccessful;

withdrawing the setting assembly from the well while leaving the downhole tool in the well, wherein the shoe dissolves in a fluid in the well in response to determining that attempting to set the downhole tool is unsuccessful; and drilling out the slips assembly, the cone, or both after dissolving the at least a portion of the shoe.

2. The method of claim 1, wherein dissolving the shoe occurs prior to withdrawing the setting assembly so as to permit the setting assembly to be released from the shoe.

3. The method of claim 1, further comprising:

deploying a first impediment to a first seat of the cone of the downhole tool; and increasing a pressure of the well uphole of the downhole tool, wherein the pressure generates an axial force on the cone at least partially via the first impediment, and wherein the first impediment prevents at least a portion of the cone from deforming radially inward.

4. The method of claim 3, further comprising:

deploying a second impediment to a second seat of the cone of the downhole tool, such that the second impediment is held by engagement with the second seat at a position that is at least partially outside of the cone.

5. The method of claim 4, further comprising:

increasing a pressure of the well uphole of the downhole tool, wherein the pressure generates an axial force on the cone at least partially via the second impediment, wherein the axial force drives the cone axially into the slips assembly which causes the cone to deform radially inwards such that the downhole tool is at least partially unset; and displacing the downhole tool in the well after the downhole tool is at least partially unset.

6. The method of claim 5, wherein the second seat is positioned such that the second impediment permits radial-inward deflection of the cone when the second impediment engages the second seat, and wherein the first seat is positioned such that the first impediment resists radial-inward deflection of the cone when the first impediment engages the first seat.

7. The method of claim 5, wherein at least a portion of the slips assembly, the cone, or both is made of a composite material that does not dissolve in the fluid.

8. The method of claim 5, wherein connecting the setting assembly to the downhole tool comprises receiving a rod through the cone and into connection with the shoe, wherein a sleeve of the setting tool is configured to press against the cone, such that attempting to set the downhole tool comprises adducing the cone and the shoe axially together.

9. A method, comprising:

running a downhole tool into a well, wherein the downhole tool comprises a cone;

setting the downhole tool in the well; and introducing an impediment into the well, wherein the impediment is received into a seat formed on an inner surface of the cone, which causes the cone to deflect radially inwards and to yield or collapse, thereby unsetting the downhole tool in the well.

10. The method of claim 9, wherein a majority of the impediment is positioned outside of the cone when the impediment is received into the seat.

11. The method of claim 9, wherein the downhole tool further comprises a slips assembly, and wherein a radially outward force exerted by the cone on the slips assembly decreases in response to the cone deflecting radially inwards, yielding, or collapsing, thereby unsetting the downhole tool.

12. The method of claim 9, further comprising pulling the downhole tool out of the well once the downhole tool is unset.

13. The method of claim 9, wherein the downhole tool drops to a bottom of the well, without dissolving or being milled-out, in response to the tool being unset.

14. A method, comprising:

deploying a downhole tool into a well, wherein the downhole tool comprises a slips assembly and a cone positioned at least partially in the slips assembly;

deploying a first impediment into a first seat of the cone of the downhole tool;

increasing a pressure in the well uphole of the downhole tool, wherein the pressure generates an axial force on the cone at least partially via the first impediment, and wherein the first impediment prevents at least a portion of the cone from deforming radially inward;

deploying a second impediment to a second seat of the cone of the downhole tool, such that the second impediment is held by engagement with the second seat, wherein the second seat is uphole of the first seat; and increasing a pressure in the well uphole of the downhole tool, wherein the pressure generates an axial force on the cone at least partially via the second impediment, and wherein the axial force drives the cone axially into the slips assembly which causes the cone to deform radially inwards such that the downhole tool is at least partially unset.

15. The method of claim 14, wherein the axial force drives the cone axially into the slips assembly which causes the cone to yield or collapse such that the downhole tool is unset.

16. The method of claim 14, further comprising pulling the downhole tool out of the well once the downhole tool is at least partially unset.

17. The method of claim 14, wherein the downhole tool drops to a bottom of the well without being milled-out in response to the tool being at least partially unset.

18. The method of claim 14, wherein the first seat is positioned such that the first impediment resists radial-inward deflection of the cone when the first impediment engages the first seat, and wherein the second seat is positioned such that the second impediment permits radial-inward deflection of the cone when the second impediment engages the second seat.

19. The method of claim 14, further comprising connecting a setting assembly to the downhole tool, wherein the setting assembly is deployed into the well with the downhole tool.

20. The method of claim 14, wherein the second impediment is held by engagement with the second seat at a position that is at least partially outside of the cone.

* * * * *